US008734106B2

(12) United States Patent
May et al.

(10) Patent No.: US 8,734,106 B2
(45) Date of Patent: May 27, 2014

(54) CEILING FIXTURE PROTECTION SYSTEM AND METHOD

(75) Inventors: Dawn R. May, Austin, TX (US); Tracy G. Hinterman, Round Rock, TX (US)

(73) Assignee: AH-HA Designs, Inc., Round Rock, TX (US)

( * ) Notice: Subject to any disclaimer, the term of this patent is extended or adjusted under 35 U.S.C. 154(b) by 452 days.

(21) Appl. No.: 13/134,070

(22) Filed: May 28, 2011

(65) Prior Publication Data

US 2011/0293413 A1 Dec. 1, 2011

Related U.S. Application Data

(60) Provisional application No. 61/349,428, filed on May 28, 2010.

(51) Int. Cl.
*F04D 29/00* (2006.01)
*F01D 25/00* (2006.01)

(52) U.S. Cl.
USPC ..... 416/62; 416/146 R

(58) Field of Classification Search
USPC ..... 416/62, 146 R
See application file for complete search history.

(56) References Cited

U.S. PATENT DOCUMENTS

| | | | | |
|---|---|---|---|---|
| 2,923,463 | A * | 2/1960 | Shunkwiler | 416/247 R |
| 3,972,309 | A * | 8/1976 | Cortner, Jr. | 119/661 |
| 4,402,649 | A * | 9/1983 | Laurel | 416/5 |
| 5,007,811 | A * | 4/1991 | Hopkins | 135/16 |
| 5,281,093 | A * | 1/1994 | Sedlak et al. | 416/62 |
| 5,591,005 | A * | 1/1997 | McCready | 416/62 |
| 5,868,189 | A * | 2/1999 | Jarvis | 150/165 |
| 6,019,479 | A * | 2/2000 | Barker | 362/96 |
| 6,199,813 | B1 * | 3/2001 | Oliva | 248/343 |
| 6,394,757 | B1 * | 5/2002 | Lackey | 416/244 R |
| 6,619,920 | B1 * | 9/2003 | Cannon | 416/62 |
| 6,644,927 | B2 * | 11/2003 | Bucher et al. | 416/244 R |
| 6,916,217 | B1 * | 7/2005 | Crepeau | 440/71 |
| 8,100,652 | B2 * | 1/2012 | Bauer et al. | 416/62 |
| 8,342,806 | B1 * | 1/2013 | Stabe, Jr. | 416/146 R |
| 8,348,610 | B1 * | 1/2013 | Wilson | 416/5 |
| 2002/0141873 | A1 * | 10/2002 | Lackey | 416/244 R |
| 2010/0008777 | A1 | 1/2010 | Bauer et al. | |
| 2011/0103982 | A1 * | 5/2011 | A. et al. | 417/423.9 |
| 2011/0305571 | A1 * | 12/2011 | Heim et al. | 416/62 |
| 2012/0224967 | A1 * | 9/2012 | Radabaugh | 416/62 |

* cited by examiner

*Primary Examiner* — Nathaniel Wiehe
*Assistant Examiner* — Wayne A Lambert
(74) *Attorney, Agent, or Firm* — The Villhard Patent Group

(57) ABSTRACT

Devices, apparatus, systems (and related methods) which protect various features of ceiling fixtures, such as fans, chandeliers, lights, and other fixtures, during painting and remodeling processes. The presently disclosed apparatus may be installed and removed quickly and easily, and both disposable and reusable embodiments are possible.

13 Claims, 2 Drawing Sheets

CEILING FIXTURE PROTECTION SYSTEM AND METHOD

CROSS-REFERENCE TO RELATED APPLICATIONS

This application claims the benefit of provisional patent application Ser. No. 61/349,428, filed 2010 May 28 by the present inventors and which is incorporated herein as if set forth in full.

FIELD

This disclosure relates in general to the field of painting or remodeling interior spaces. More particularly, the disclosure relates to shielding fans, light fixtures, and other ceiling fixtures during such activities.

BACKGROUND

Professional painters and home improvement amateurs must protect all surfaces from paint splatter. Painting preparation is a time consuming and arduous task that is difficult and disliked by most. Paint clean up after the job may be just as time consuming, if not more so. Time spent in clean up of overspray may be reduced by spending time at the outset taping off areas not to be painted.

The most common methods of covering a ceiling fan currently are taping plastic to the fan or removing the blades and taping off the motor housing. Among known problems with using plastic and tape for fans and lighting fixtures are the amount of plastic necessary, the awkwardness of the size of plastic needed to cover the circumference, the position of the fixture over the users head, turning of fan blades while working on covering the ceiling fan, and obstruction of the motor housing caused by the blades.

These methods are very time consuming and difficult. Among known problems with the removal of fan blades are the time taken to remove and restore, the possibility of the blades being lost or damaged during the job, and the chance that the fan will no longer be balanced when the blades are restored, leaving the ceiling fan useless. Thus it is recognized that there is a need for devices which provide quick and easy masking of ceiling fixtures for protection from ceiling covering applications including, but not limited to paint, joint compound, plaster and dust.

In conclusion, no ceiling fixture cover, in so far as I am aware, has been previously developed to be used to protect the entire ceiling fixture including the hanging device from paint or other harmful elements, being disposable and designed to be installed and removed quickly. It can be seen from the above discussion of the background, that there is a continuing need for new and improved means for protecting ceiling fixtures during painting and other like processes.

SUMMARY

Therefore, a need has arisen for an improved shielding system. The system of the present disclosure may alleviate several of the problems with known systems.

Some embodiments provide a cover for a fan which includes at least one fan blade operatively connected to a fan body which is connected to a fan canopy by a pipe. The cover of the current embodiment comprises a fan blade and body portion which further comprises a sheath and a closure member. The sheath defines a top surface, a bottom surface, a periphery, and a radial direction. Furthermore, the closure member defines a slit extending across at least a portion of the top surface, the periphery, and at least a portion of the bottom surface.

In some embodiments the slit extends across the top surface from a center of the blade cover to the periphery of the blade cover and extends across the periphery and the bottom surface from the periphery to about one half of the distance from the periphery to the center of the blade and body cover. Furthermore, the closure member can comprise a set of hook and loop fasteners. Additionally, the set of hook and loop fasteners can extend across the top surface in a generally circular arc at a radial distance from the center of the blade and body cover and can be positioned across the slit.

Moreover, the cover can include a generally cylindrical fan pipe and canopy portion which further defines a longitudinal axis and which is shaped and dimensioned to generally enclose a fan pipe and canopy. In some embodiments, the fan pipe and canopy portion can also comprise another closure member defining another slit extending in a direction generally parallel to the longitudinal axis which can be used to adjust the fan pipe and canopy portion to fit fans of varying sizes and configurations.

These and other advantages of the disclosed subject matter, as well as additional novel features, will be apparent from the description provided herein. The intent of this summary is not to be a comprehensive description of the subject matter of the present disclosure, but rather to provide a short overview of some of the subject matter's functionality. Other systems, methods, features and advantages here provided will become apparent to one with skill in the art upon examination of the following FIGURES and detailed description.

ADVANTAGES

Accordingly several advantages of one or more aspects are as follows: to provide a temporary and disposable protective cover for the ceiling fan and/or light fixtures as ceiling covering applications are applied, that are relatively inexpensive, and can be used by any person in the industry or any individual without skill prior to applying the ceiling covering, such as paint. Other advantages are the speed in which this cover can be installed and removed compared to previous methods of protecting ceiling fans during messy and dusty applications of ceiling coverings. These will be apparent from a consideration of the drawings and ensuing description.

DRAWINGS—FIGURES

The features, nature, and advantages of the disclosed subject matter may become more apparent from the detailed description set forth below when taken in conjunction with the drawings, in which like reference numerals indicate like features and wherein.

DETAILED DESCRIPTION

Figure 1:
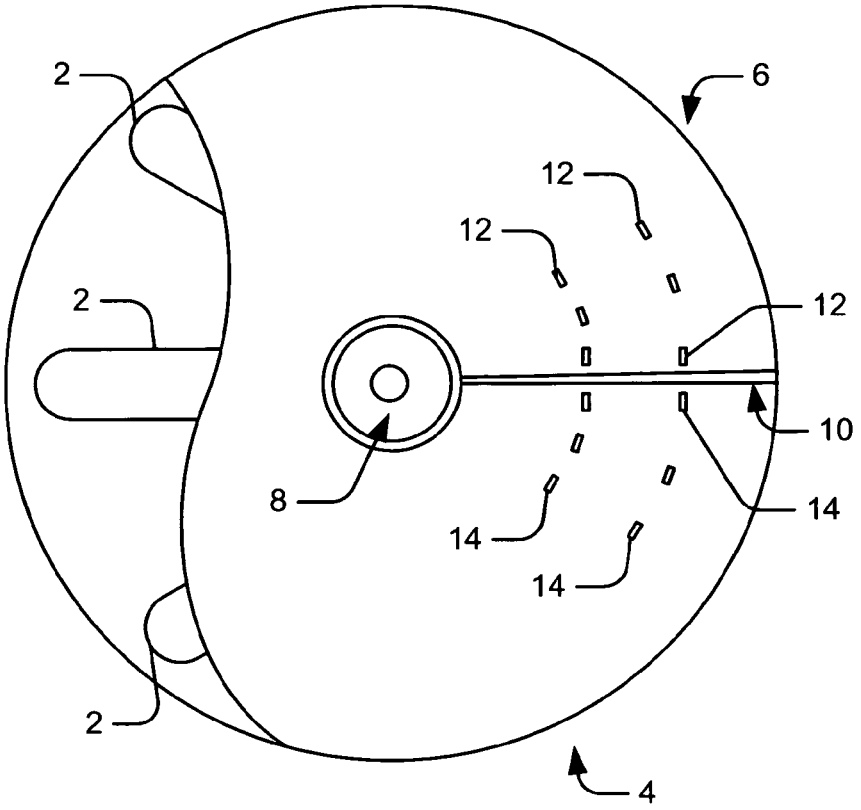
FIG. 1 shows a top view of a fan being covered in accordance with the present disclosure.

The following description is not to be taken in a limiting sense, but is made for the purpose of describing the general principles of the present disclosure. Exemplary embodiments of the present disclosure are illustrated in the drawings, like numbers being used to refer to like and corresponding parts of the various drawings.

FIG. 1 shows a top view of a portion of an embodiment of the present disclosure. A fan with blades 2 is shown covered by this portion. In some embodiments two circular or oval, with some embodiments a 30 to 60 inch diameter pieces of light weight, water resistant fabric (in some embodiments, polypropylene with a polyethylene coating may be used) sewn or glued together at circumferential edge 6. Top side 4 of this portion has a three to six inch diameter hole 8 in the center. Slit 10 runs from hole 8, extends through the whole radius of top side 4, through circumferential edge 6, and back to half the radius of the bottom of the fan cover. Slit 10 (or "opening") has tabs 14 (in some embodiments, Velcro or other hook-and-loop type tabs; in disposable embodiments, single- or double-sided tape may also be used) sewn onto the edge of slit 10. In non-disposable embodiments, when hook-and-loop tape is used, Tabs 14 attaches to corresponding tabs 12 at various measurements, securing closure and allowing protective overlap given the size of the particular fan being covered, as shown. In a disposable embodiment, double-sided tape secures closure allowing overlap. A circular piece of Velcro, other hook-and-loop fastener material, or tape is also included at hole 8 for attachment to the portion of the cover that is detailed in FIG. 2.

Note that FIG. 1 illustrates a partial cutaway view with some fan blades 2 exposed for illustrative purposes. Those skilled in the art understand that the cover of the current embodiment includes material in the cutaway section so that the cover can cover all of the fan blades 2 and the fan body of various fans.

Figure 2:
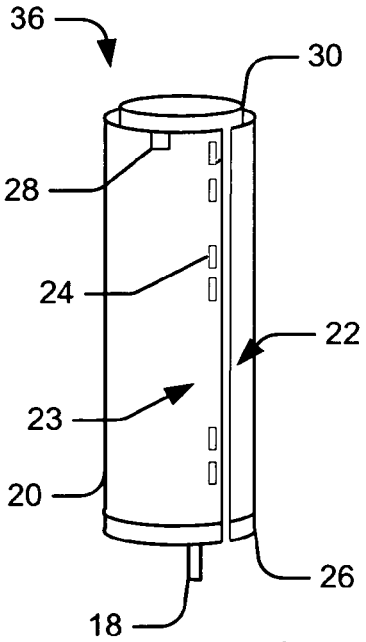
FIG. 2 shows a side detail view of an aspect of the present disclosure.

FIG. 2 depicts a side view of a portion 36 of this embodiment, which is for covering the pole or chain that the ceiling fixture may be suspended from. Pole 18 can range in length but it may be covered by a long rectangular piece of fabric 20 that has Velcro or other hook-and-loop fastener material (not shown) attached to edge 22 lengthwise with the complementary piece 24 attached lengthwise midway. The Velcro is used to fasten the two long edges to each other, overlapping edges by some amount, approximately four inches in this embodiment shown by number 23. One of ordinary skill will recognize that tape could be used here instead of Velcro, particularly for disposable embodiments of the present disclosure. Strip 26 of Velcro, other hook-and-loop fastener material, or tape is also attached across the bottom width. Strip 26 will attach to the Velcro on hole 8 from FIG. 1 to secure the pole cover to the fan cover protecting the pole and fan from overspray. In some embodiments, a magnet 28 is attached to fabric 20 for facilitating easy installation and removal of fabric 20 to lighting fixture canopy 30 or pole 18 when canopy 30 or pole 18 is made of a ferromagnetic material.

Figure 3:
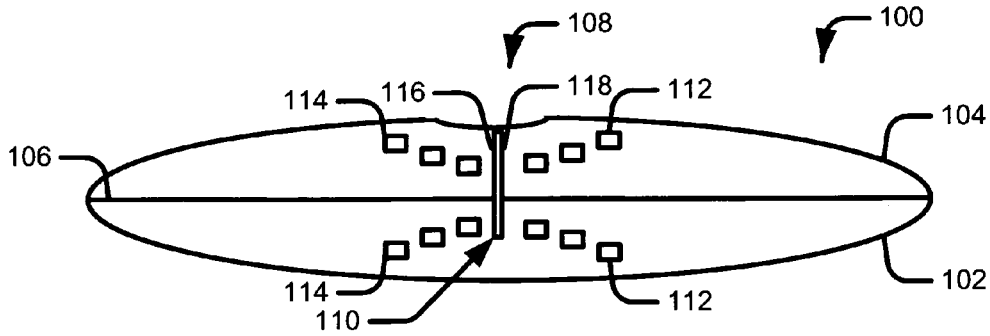
FIG. 3 shows a side elevation view of a fan blade and body cover.

With reference now to FIG. 3, the drawing illustrates aspects of a blade cover 100. The blade and body cover 100 of the current embodiment comprises a sheath which includes a bottom panel 102 and a top panel 104. The blade and body cover 100 is generally circular although other shapes (for instance, octagonal, hexagonal, oblong, etc.) are within the scope of the disclosure. The bottom and top panels 102 and 104 may be made of any fabric, paper, paper-like material, elastomer, etc. suitable for covering the fan blades 2 and the fan body, and/or other portions of a ceiling fan such as the motor. For instance, some embodiments use polypropylene with a polyethylene coating to protect the fan blades 2 (See FIG. 1). Henceforth, the portions of the fan at the lower end of the pipe 18 (see FIG. 1) other than the blades 2 will be referred to as the fan body for convenience. While FIG. 3 illustrates the bottom and top panels 102 and 104 as being separate pieces sewn together at a seam 106 along their periphery, in some embodiments the blade and body cover 100 could be of one-piece construction or even made from multiple panels, sheets, etc. of material.

As illustrated in FIG. 3 the blade and body cover 100 defines a top center hole 108 and a slit 110. More particularly, the slit 110 can extend from generally near (or at) the top center hole 108 in a generally radial direction to the seam 106. The slit 110 can also extend across or through the seam 106 such that it reaches the bottom panel 102. Further, slit 110 can extend inward in a generally radial direction across the bottom panel 102 to some desired extent. For instance, the slit 110 could extend across the bottom panel 102 for a distance of about one half of the radius thereof. In other embodiments, the lengths, orientation, and starting, and ending points of the slit 110 can be varied without departing from the scope of the disclosure. In some embodiments, the length, position, and orientation of the slit 110 is such that a user can open the slit 110 and slip the blade cover 110 over (or about) the blades 2 (see FIG. 1).

With continuing reference to FIG. 3, once the user has slipped the blade and body cover 100 over the blades 2 and the fan body, the user can adjust the amount of slack in the blade and body cover 100 as might be desired and close the blade and body cover 100 over the fan blades 2. The user can then use the tabs 112 and 114 to ensure that the blade and body cover 100 will stay closed in most circumstances. In some embodiments the tabs 112 and 114 are portions of hook and loop fasteners and the user can pull one edge 116 (which partial defines the slit 110) of the blade cover 100 over the other edge 118 of the blade and body cover 100. Thus, the user can position one or more tabs 114 over one or more tabs 112 thereby adjusting the blade and body cover 100 so that little or no portions of the bottom and top panels 102 and 104 appear to be "loose" or hanging from the blades 2. More particularly, whereas the slit 110 has a generally radial orientation, (sub) sets of the tabs 112 and 114 can extend from the area of the slit 110 along generally circular arcs at desired radial distances from the top center hole 108. Note that as illustrated by FIG. 3, one set of the tabs. 112 (for instance, the hook portions of hook and loop fasteners) is positioned on one side of the slit 110 while the other set of tabs 114 (for instance, the loop portions of hook and loop fasteners) is positioned on the other side of the slit 110.

Figure 4:
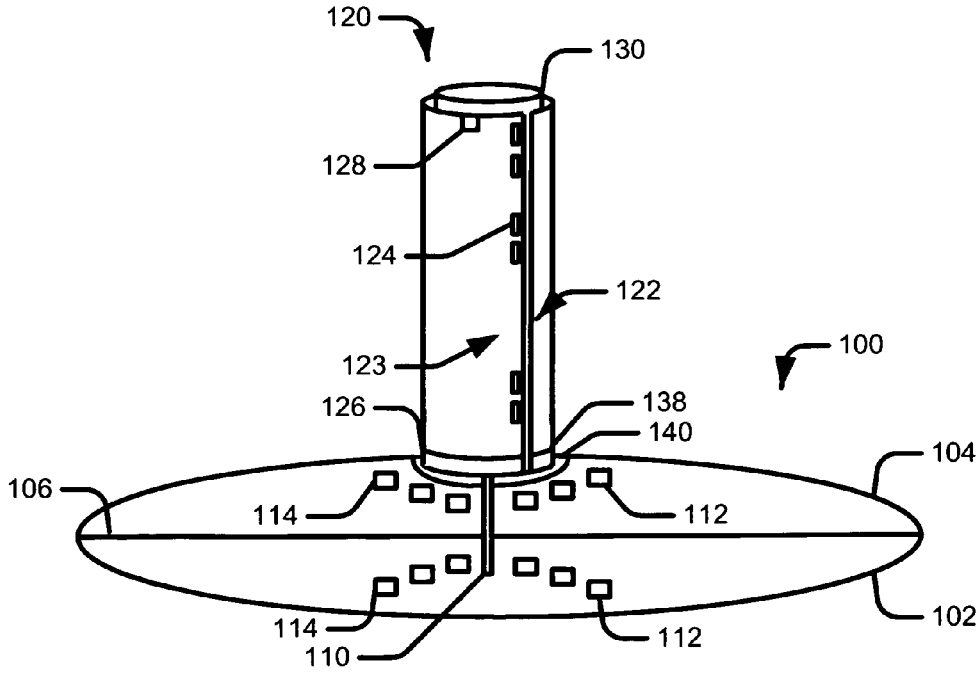
FIG. 4 shows a side elevation view of a fan cover.

With reference now to FIG. 4, the drawing illustrates a fan cover including both a blade and body cover 100 and a pipe and canopy cover 120. More particularly, FIG. 4 illustrates the blade and body cover 100 and pipe and canopy cover 120 joined together such that while the blade and body cover 100 covers blades 2 (see FIG. 1) and the fan body (not shown) of a fan, the pipe and canopy cover 120 covers other portions of the fan such as the pole 18 (not shown), canopy 30, etc. In addition, FIG. 4 illustrates that hook and loop fasteners 138 and 140 (positioned on or near bottom strip 126 of the body cover 120 and top center hole 108 (not shown) of the blade and body cover 100) can releasably attach the blade and body cover 100 and the pipe and canopy cover 120.

Note that the FIGURES generally show the tabs 12, 14, 112, and 114 as being on the exterior surface of the respective covers for illustrative purposes. However, those skilled in the art will recognize that one of each pair of respective tabs 112 and 114 (and 12 and 14) will usually be positioned on the exterior surface while the other will be on the interior surface. In addition, covers of some embodiments will have enough material in the respective bottom and top panels 102 and 104 such that the blade and body cover 100 covers the fan blades and the fan body 2 and has sufficient material so that the various sets of tabs 112 and 114 can be aligned with each other. Moreover, the various tabs 112 and 114 may be spaced apart from each other by desired distances (for instance, several inches) to allow the blade and body cover 100 and/or pipe and canopy cover 120 to be adjusted to fans of differing sizes and configurations. Note that the blade and body cover 102 also can have sufficient volume (and therefore height) to enclosed both the blades 2 and the fan body at the lower end of the fan pipe 18.

With continuing reference to FIG. 4, FIG. 4 also illustrates that the fan pipe and canopy cover 120 of some embodiments is sized and dimensioned to enclose the parts of a fan besides the blades 2 and the fan body at the lower end of the pipe 18. For instance, in the current embodiment the fan pipe and canopy cover 120 is a piece of suitable material shaped into a cylinder large enough to fit over the canopies 30, pipes 18, etc. of many if not all ceiling fans. The fan pipe and canopy cover 120 defines a longitudinal slit and overlapping edges 122 and 123. Overlapping edges 122 and 123 of the fan pipe and canopy cover 120 can be pulled one over the other to enclose various parts of a ceiling fan. Hook and loop fasteners 124 (or other types of fasteners) positioned near the edges 122 and 123 can be used to secure the edges 122 and 123 in overlapping relationship to each other thereby enclosing the fan canopy 130.

Additionally, FIG. 4 illustrates that the fan pipe and canopy cover 120 includes a magnet 128 positioned near one of its ends. The magnet 128 can be used to secure the fan pipe and canopy cover 120 in place by magnetically coupling with ferromagnetic or ferrimagnetic portions of a fan canopy 130 and/or pipe 18. Those skilled in the art appreciate that since the fan blade and body cover 100 covers the fan blades 2 and body while the fan pipe and canopy cover 120 covers the fan pipe 18 and canopy 130 neither cover need by dimensioned to cover both the fan body and the fan canopy 130. Since these portions of many fans have differing diameters (as well as other dimensions and configurations) separating the functions of covering the fan canopy 130 and covering the fan body allows covers of the current embodiment to cover many more and different fans than heretofore possible with one overall cover. Additionally, separating the functions allows for a much smaller top center hole 108 than would otherwise be the case. In some embodiments, the top center hole 108 is only about 8 inches in diameter although other sizes and configurations are within the scope of the disclosure.

The foregoing description of embodiments is provided to enable a person skilled in the art to make and use the claimed subject matter. Various modifications to these embodiments will be readily apparent to those skilled in the art, and the generic principles defined herein may be applied to other embodiments without the use of the innovative faculty. Thus, the claimed subject matter is not intended to be limited to the embodiments shown herein but is to be accorded the widest scope consistent with the principles and novel features disclosed herein. What is claimed is all of the subject matter described in this disclosure.

The invention claimed is:

1. A cover for a fan including at least one fan blade, a fan body operatively coupled to the fan blade, a fan pipe coupled to the fan body, and a fan canopy coupled to the fan pipe, the cover comprising:

a cylindrical fan pipe and canopy portion further comprising a longitudinal axis and being shaped and dimensioned to enclose the fan pipe and canopy, the fan pipe and canopy portion further comprising a first closure member defining a first slit extending in a direction parallel to the longitudinal axis;

a fan blade and body portion further comprising a sheath defining a top surface, a bottom surface, a periphery, and a radial direction, the fan blade and body portion further comprising a second closure member defining a second slit extending across at least a portion of the top surface, the periphery, and at least a portion of the bottom surface; and the fan pipe and canopy portion and the fan blade and body portion being releasably attached at about a center of the fan blade and body portion.

2. The cover of claim 1 further comprising a magnet positioned on the fan pipe and canopy portion toward an end of the fan pipe and canopy portion.

3. The cover of claim 2 wherein the magnet is magnetically bound to a magnetic material of the fan.

4. The cover of claim 1 wherein the second slit extends across the top surface from a center of the fan blade and body cover to the periphery of the fan blade and body cover and extends across the bottom surface from the periphery to about one half of the distance from the periphery to the center of the fan blade and body cover.

5. The cover of claim 1 wherein the second closure member further comprises a set of hook and loop fastener.

6. The cover of claim 1 wherein the set of hook and loop fasteners extend across the top surface in a circular arc at a radial distance from the center of the fan blade and body cover and being positioned across the slit.

7. The cover of claim 1 wherein a hook and loop fastener releasably attaches the fan pipe and canopy cover and the fan blade and body cover.

8. A cover for a fan including at least one fan blade, a fan body operatively coupled to the fan blade, a fan pipe coupled to the fan body, and a fan canopy coupled to the fan pipe, the cover comprising:

a fan blade and body portion further comprising a sheath defining a top surface, a bottom surface, a periphery, and a radial direction, the fan blade and body portion further comprising a closure member defining a slit;

the slit extending across the top surface from a center of the blade and body cover to the periphery of the blade and body cover and extending across the bottom surface from the periphery to about one half of the distance from the periphery to the center of the fan blade and body cover;

a closure member extending across the top surface in a circular arc at a radial distance from the center of the fan blade and body cover and being positioned across the slit; and a releasable attachment point for releasable attachment to a fan pipe and canopy portion of the cover.

9. A cover for a fan including at least one fan blade, a fan body operatively coupled to the fan blade, a fan pipe coupled to the fan body, and a fan canopy coupled to the fan pipe, the cover comprising:

a fan blade and body portion further comprising a sheath defining a top surface, a bottom surface, a center, a periphery, and a radial direction, the fan blade and body portion further comprising a closure member defining a slit extending across at least a portion of the top surface, the periphery, and at least a portion of the bottom surface; and a closure member extending across the top surface in an arc at a radial distance from the center of the fan blade and body cover and being positioned across the slit.

10. The cover of claim 9 wherein the slit extends across the top surface from about a center of the blade and body cover to the periphery of the fan blade and body cover and extends across the bottom surface from the periphery to about one half of the distance from the periphery to the center of the fan blade and body cover.

11. The cover of claim 9 wherein the closure member further comprises a set of hook and loop fasteners.

12. The cover of claim 11 wherein the set of hook and loop fasteners extends across the top surface in a circular arc at a radial distance from the center of the fan blade and body cover and being positioned across the slit.

13. The cover of claim 9 further comprising a cylindrical fan pipe and canopy portion further comprising a longitudinal axis and being shaped and dimensioned to enclose a fan pipe and fan canopy, the fan pipe and canopy portion further comprising another closure member defining another slit extending in a direction generally parallel to the longitudinal axis.

* * * * *